US006093094A

United States Patent [19]

Uecker et al.

[11] Patent Number: 6,093,094

[45] Date of Patent: Jul. 25, 2000

[54] COIN FEED MECHANISM

[75] Inventors: Richard P. Uecker, Juneau; Joseph P. Hanus, Johnson Creek, both of Wis.

[73] Assignee: De La Rue Systems Americas Corporation, Watertown, Wis.

[21] Appl. No.: 09/201,917

[22] Filed: Dec. 1, 1998

Related U.S. Application Data

[63] Continuation-in-part of application No. 08/980,845, Dec. 1, 1997, abandoned.

[51] Int. Cl.[7] ..... G07D 9/00; G07F 1/04

[52] U.S. Cl. ..... 453/16; 453/63; 194/346; 194/347

[58] Field of Search ..... 453/16, 17, 63; 206/0.8; 194/320, 325, 347, 346, 344; 457/222

[56] References Cited

U.S. PATENT DOCUMENTS

| | | | |
|---|---|---|---|
| 3,229,806 | 1/1966 | Otto et al. | 198/54 |
| 4,480,651 | 11/1984 | Nakai et al. | 194/235 |
| 5,016,745 | 5/1991 | Schoeb et al. | 453/18 |
| 5,064,404 | 11/1991 | Champion | 453/17 |
| 5,220,988 | 6/1993 | Wilfong et al. | 194/346 |
| 5,326,312 | 7/1994 | Patroni | 453/57 |
| 5,429,551 | 7/1995 | Uecker et al. | 453/57 |
| 5,842,916 | 12/1998 | Gerrity et al. | 453/17 |

FOREIGN PATENT DOCUMENTS

| | | |
|---|---|---|
| 0 080 858 A2 | 6/1983 | European Pat. Off. . |
| 2 208 738 | 4/1989 | United Kingdom . |

*Primary Examiner*—Robert P. Olszewski
*Assistant Examiner*—Bryan Jaketic
*Attorney, Agent, or Firm*—Quarles & Brady LLP

[57] ABSTRACT

A coin feed control apparatus includes a hopper (20) having a discharge opening (17) that is disposed above a rotating disc (10) of a coin handling machine. The discharge opening (17) is positioned over a coin receiving region (14) of the disc. A coin feed control member (30) is mounted for pivotal movement to further open or further close the discharge opening (17). The feed control member (30), the discharge opening (17) and the coin receiving region (14) are sized such that the feed control member (30) will tend to move to partially close the discharge opening (17) in response to a build-up of coins in the coin receiving region, and thereby limit the flow of coins through the discharge opening (17), and such that the reduction of coins in the coin receiving region (14) will allow the feed control member (30) to drop and further open the discharge opening (17) to allow a greater flow of coins into the coin receiving region. A slidable, tiltable and removable inspection pan (40) that rests on the hopper (20) is also disclosed.

19 Claims, 3 Drawing Sheets

5
5
10
13
14
21
22
23
24
25
27
30
31
32
33
34
35
40
41
42
43
44
47
49
50

FIG. 5
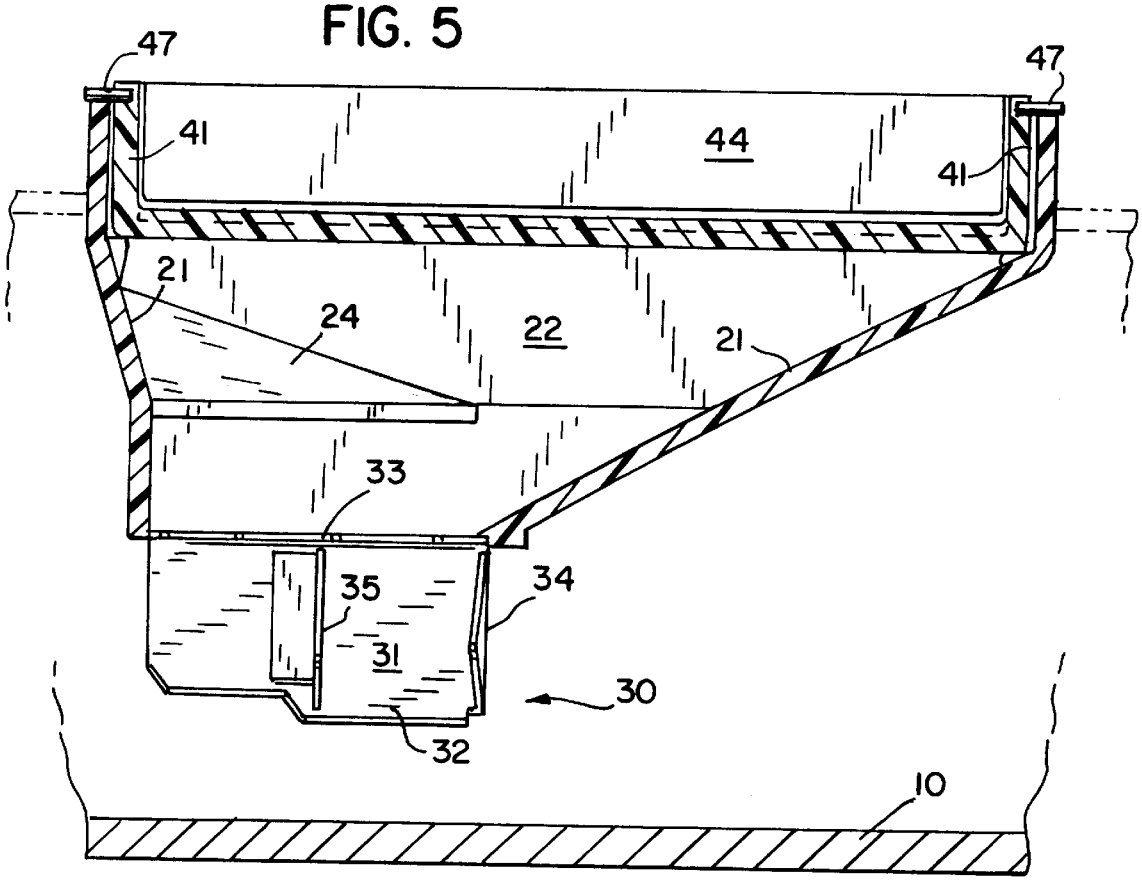
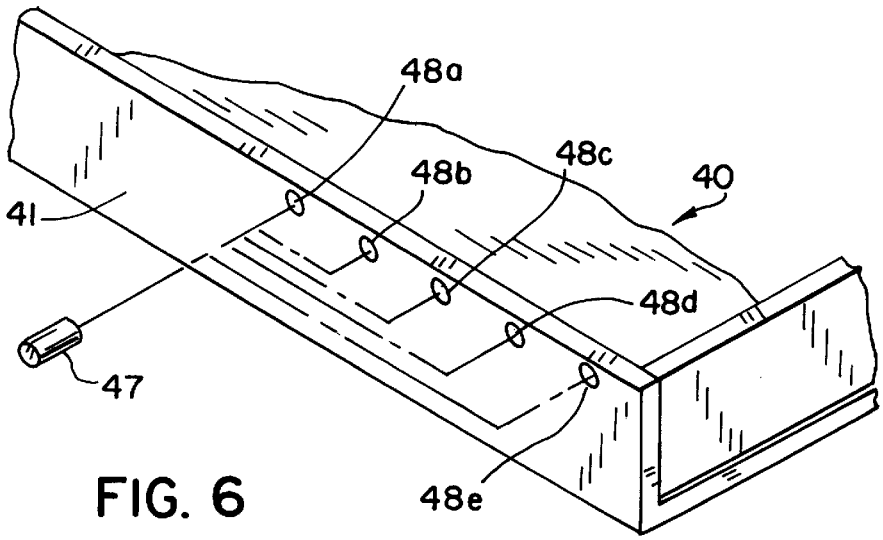
FIG. 6

COIN FEED MECHANISM

CROSS-REFERENCE TO RELATED APPLICATIONS

This application is a continuation-in-part of copending U.S. application. Ser. No. 08/980,845, filed Dec. 1, 1997, now abandoned.

TECHNICAL FIELD

This invention relates to coin handling, and particularly to a mechanism for controlling the feeding of coins to a coin counting or sorting machine.

BACKGROUND OF THE INVENTION

One form of coin handling machine deposits coins on the top surface of a rotating disc which aligns the coins into a single layer and single file for subsequent counting or sorting. An example of such a coin handling machine is described in Adams et al., U.S. Pat. No. 5,295,899 issued Mar. 22, 1994, for "Two Disc Coin Handling Apparatus". In such machines, it is important that the coins be deposited on the rotating disc in a controlled manner so that a suitable level of coins on the disc can be maintained. Maintaining a suitable level of coins on the disc prevents jamming, maintains a high throughput, and minimizes counting or sorting errors.

In the past, the coin feed has been controlled using motorized feed mechanisms, including drive linkages, which are controlled in response to level sensors. The present invention provides a control mechanism that requires no motorized mechanisms, linkages or electrical or electronic circuitry.

SUMMARY OF THE INVENTION

The invention is embodied in an apparatus including a hopper having a discharge opening that is disposed above a rotating disc of a coin handling machine. The discharge opening is positioned over a coin receiving region of the disc, the coin receiving region having a transverse extent which is limited by a deflector member operating in conjunction with the disc to convert the coins from a pile to a few layers and eventually to a single file. A coin feed control member is mounted for pivotal movement to further open or further close the discharge opening.

As the level of coins on the rotating disc increases, the coins will cause the coin feed control member to pivot and to tend to close off the discharge opening in a throttling action. Similarly, as the level of coins on the disc decreases, the weight of the coins in the hopper will allow the coin feed control member to further open the discharge opening, thereby increasing the flow of coins onto the rotating disc.

Preferably, the hopper is funnel-shaped with the discharge opening at the base of the funnel. The inner surfaces of the hopper are crowned positive along gradients descending at right angles to the discharge opening, so that the coins will tend to keep sliding and not come to rest on surfaces leading to the discharge opening.

A removable inspection pan may be mounted on the open top of the hopper. Preferably, the inspection pan rests on the top edges of the hopper and can be slid along the top edges to dump its contents into the hopper. Preferably, projections extend from the sides of the inspection pan to ride along the edges of the hopper. The position of the projections along the length of the pan is adjustable to change the point at which the pan will pivot to empty its contents into the open top of the hopper.

It is a principal object of the invention to provide a simple but effective control for feeding coins from a hopper to a rotating disc, without utilizing mechanisms of the prior art which controlled the hopper throttle member.

It is a further object of the invention to provide such a mechanism which contains only one moving part that is controlled by the relative volumes of coins on the disc and in the hopper.

It is also an object of the invention to provide an inspection pan mountable on the hopper in a manner such that its contents can be easily emptied into the hopper by an operator.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 5 is a view in section and partially in elevation taken in the plane of the line 5—5 of FIG. 3; and FIG. 6 is a partial view in perspective of the inspection pan showing alternative mounting positions for projections on the pan.

DETAILED DESCRIPTION OF THE PREFERRED EMBODIMENTS

Figure 1:
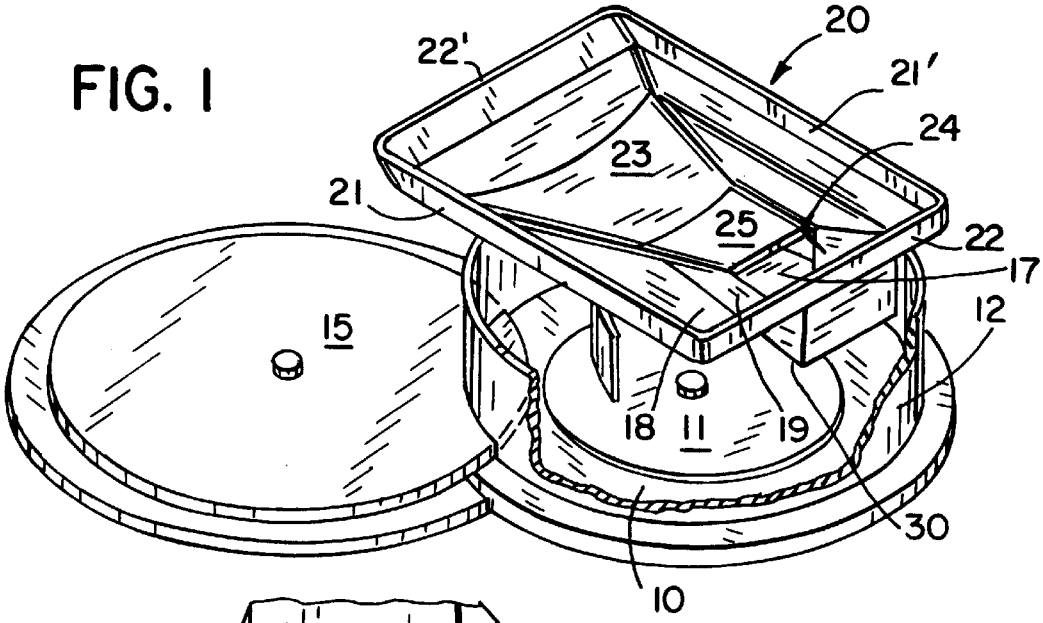
FIG. 1 is a stylized perspective view of a coin sorter with which the feed mechanism of the present invention may be used.

The coin feed mechanism is shown in connection with a two disc coin sorter of the type illustrated and described in Adams et al., U.S. Pat. No. 5,295,899, issued Mar. 22, 1994 for a "Two Disc Coin Handling Apparatus." Such a coin sorter includes a rotating feed disc 10 with a raised center portion 11 which operates within the confines of an upstanding cylindrical wall 12. Coins that are deposited on the surface of the feed disc 10 will tend to align themselves in a single file along the inner edge of the wall 12 between the wall and the raised center portion 11. A flexible deflector plate 13 extends over the surface of the feed disc 10 to permit only a few layers of coins to pass beneath the lower edge of the deflector plate 13. Eventually, a single layer and then a single file of coins is presented to a second rotating disc 15 which overlies a portion of the feed disc 10. The second disc 15 mounts a series of flexible fingers on its underside. The fingers carry the coins along a circular path defined by a rim 16. The coins against the rim 16 encounter a series of openings that are sized for particular denominations of coins. The coins are sorted by falling through the opening that is unique to the diameter of coin of a particular denomination.

A hopper 20 is disposed above the feed disc 10. The hopper 20 has a generally rectangular open top defined by sidewalls 21, 21', and end walls 22, 22'. The sidewalls 21, 21' lead to downwardly sloping interior surfaces 18 and 23, respectively, which lead to further downwardly sloping interior surfaces 19 and 25, respectively. The surfaces 18,19 and 23, 25 present a slope which is crowned slightly positive along two gradients descending at right angles to the discharge opening 17, to cause the coins to accelerate downward toward the discharge opening 17. A triangular, sloped baffle member 24 occupies a triangular half-section of the rectangular area at the bottom of the funnel-shaped hopper 20. The discharge opening 17 is rectangular in shape, with part of the opening 17 being obscured by baffle member 24 in FIG. 2. The baffle member 24 limits the pressure of the coins in the hopper 20 against the door 30.

Figure 2:
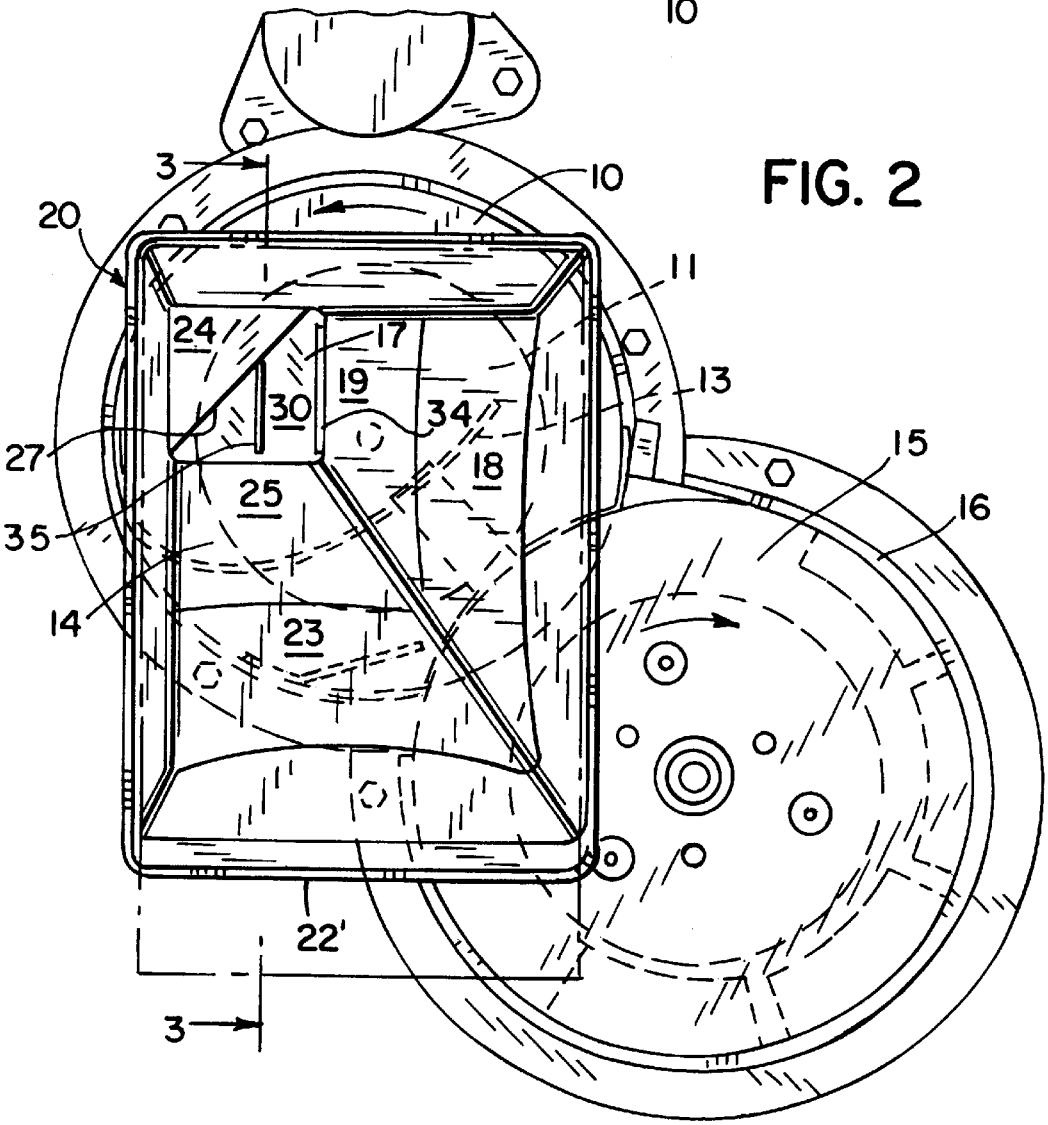
FIG. 2 is a top plan view of a coin sorter with the feed mechanism in place.

Although the discharge opening 17 is shown as being rectangular and as being located toward the left side of the hopper as viewed in FIG. 2, the invention contemplates other shapes of discharge openings such as triangular, circular or irregular, and positioning in various positions over the feed disc 10.

A control member 30 is mounted just below the discharge opening 17 to control the flow of coins from the hopper 20 onto the disc 10. The control member 30 includes a non-identical pair of spaced apart, upwardly projecting, triangular guide flanges 34 and 35 that guide and channel the coins between them down into a coin receiving region 14 seen in FIGS. 2, 3 and 4. This coin receiving region 14 is bounded on the sides by the deflector member 13 and the outside wall 12 of the disc 10.

The control member 30 is mounted by hinge 33 (FIG. 3) just below the front end wall 22. Other methods of pivotally mounting the control member 30 can also be used.

Figures 3, 4:
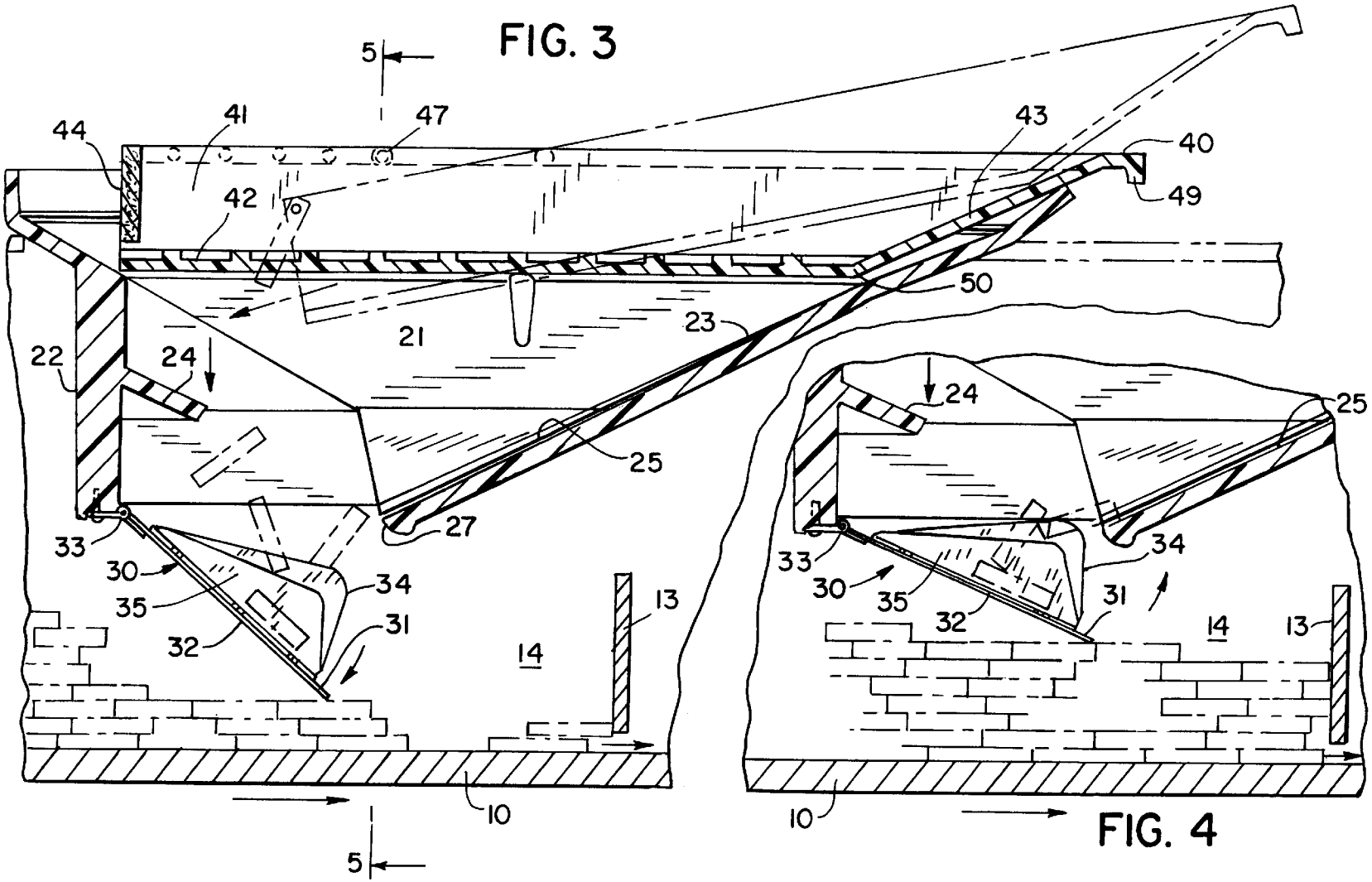
FIG. 3 is a view of coin sorter with an inspection pan of the present invention, taken in the plane indicated by line 3—3 in FIG. 2.
FIG. 4 is a partial view in vertical section similar to FIG. 3, but showing the control member in a different position.

As illustrated in FIGS. 3 and 4, the control member 30 functions as a door for the hopper 20, which moves from a fully open position to a closed position where a lip 31 of the member 30 abuts an edge 27 of the discharge opening 17. The feed control member 30, the discharge opening 17 and the coin receiving region 14 are sized such that the feed control member 30 will tend to move to at least partially close the discharge opening 17 in response to a build-up of coins in the coin receiving region 14. When the level of stacked coins on the feed disc 10 is high, the stacked coins will engage the control member 30 and will pivot the control member 30 upwardly to partially or nearly fully close the discharge opening 17. Because such a movement works against the weight of coins in the hopper, that weight of coins can overcome the force of stacked coins working against the control member 30 to partially or fully open the discharge opening 17. The surface area of the control member 30, its position in the path of travel of coins on the feed disc 10, and the angular orientation of the control member 30 are designed so that a desirable level of excess coins on the rotating disc 10 will adequately close off the discharge opening 17 to prevent an overload of coins from building up on the feed disc 10.

The above-described apparatus allows for the elimination of mechanisms, sensors and drive linkages for performing similar functions on prior coin handling equipment.

The open top of the hopper 20 can be closed by a removable inspection pan 4 (FIG. 3). The pan 40 is preferably generally rectangular in shape with upright parallel sidewalls 41 and a bottom 42 with recesses to collect debris. An inclined end wall 43 joins the side walls 41. The front wall of the inspection pan 40 may be defined by a pivotal door member 44 extending across the side walls 41 and containing magnets for holding paper clips and other debris that might be mixed with the coins. The sidewalls 41 are spaced apart and extend generally parallel to one another and terminate in an exit which is flush to the ends of the sidewalls 41. This is in contrast to prior art pans having a narrowing of the sidewalls for the purpose of funneling coins out of the exit.

The sides 41 of the inspection pan 40 mount outwardly extending projections in the form of pins 47 which ride along the top edges of the upright side walls 21 of the hopper 20. A plurality of openings 48A, 48B, etc. are provided adjacent the top of the side walls 41 of the pan 40 so that the position of the pins 47 can be changed. As shown in FIG. 3, the inclined end wall 43 of the pan 40 mates with the incline of the wall 23 of the hopper 20. A lip 49 extends from the pan for grasping by an operator. As the pan 40 is pulled by an operator off of the hopper 20, the edge 50 defined by the junction of the inclined wall 43 and the bottom wall 42 of the pan 40 will travel along the inclined wall 23 of the hopper thereby causing the pan 40 to tilt about the pins 47 which ride along the top edges of the upright walls 21. This tilting action will cause the contents of the inspection pan 40 to fall into the hopper 20.

No additional table top space is required for the inspection pan 40. The inspection pan 40 can be totally removed for applications in which an operator wants to dump the contents of a coin bag or other batch container directly into the hopper. Because the side walls 21, 21' and rear wall 22 of the hopper 20 are generally upright, the pivot axis defined by the pin 47 can be placed in a location where the front of the pan 40 dips into the hopper 20 as it empties. The contents at the rear of the pan 40 will counterbalance to some extent the contents forward of the pin 47 thereby assisting the user in controlling the tipping of the pan 40.

Although the invention has been described in relation to machines for handling coins, those same machines can also be used for handling other disc-like objects such as tokens. Also, instead of having adjustable pins 47 defining the pivot point of the pan on the hopper, the sides 41 of the pan could have outwardly extending lips which rest on the top edges of the upright walls 21, 21' of the hopper 20. The front edge of such lips would then define the pivot point as the inspection pan is withdrawn from the open top of the hopper.

This has been a description of the preferred embodiments. For the full scope of the embodiments contemplated by the present invention, reference is made to the claims which follow.

We claim:

1. A coin feed control apparatus for a coin handling machine having a rotating disc on which coins are received and processed, the apparatus comprising:

a hopper disposed above the rotating disc and having a discharge opening;

a coin receiving region on the rotating disc bounded by at least one coin deflecting member;

a feed control member pivotally mounted near the discharge opening and over the coin receiving region; and wherein the feed control member, the discharge opening and the coin receiving region are sized such that the feed control member will tend to move to at least partially close the discharge opening in response to a build-up of coins in the coin receiving region and thereby limit the flow of coins through the discharge opening, and such that the reduction of coins in the coin receiving region will allow the feed control member to drop and further open the discharge opening to allow a greater flow of coins into the coin receiving region.

2. The apparatus according to claim 1, wherein the feed control member is free of linkages other than its pivotal mounting near the discharge opening.

3. The apparatus according to claim 2, wherein the discharge opening is at the bottom of the hopper and the hopper has at least one sloped surface leading to the discharge opening.

4. The apparatus according to claim 3, wherein the hopper has a plurality of interior sloped surfaces which are crowned positive along gradients descending at right angles to the discharge opening, so that coins will tend to keep sliding and not come to rest on the sloped surfaces leading to the discharge opening.

5. The apparatus according to claim 3, wherein the discharge opening has a rectangular shape.

6. The apparatus according to claim 5, wherein the control member has at least one guide member projecting upwardly from the control member for channeling the coins from the discharge opening to the coin receiving region.

7. The apparatus according to claim 6, wherein the guide member is generally triangular in shape.

8. The apparatus according to claim 6, wherein the control member has a pair of spaced apart guide members projecting upwardly from the control member for channeling the coins from the discharge opening to the coin receiving region.

9. The apparatus according to claim 8, wherein the guide members are generally triangular in shape.

10. The apparatus according to claim 3, further comprising a baffle member disposed above the discharge opening in the bottom of the funnel to further control the flow of coins through the discharge opening.

11. The apparatus according to claim 10, wherein the baffle member has a triangular shape.

12. The apparatus according to claim 11, wherein the baffle member is positioned to slope downward toward the discharge opening.

13. The apparatus according to claim 1, wherein the top of the hopper is open and a removable inspection pan is disposed in the normally open top.

14. The apparatus according to claim 13, wherein the top of the hopper has spaced parallel edges and the inspection pan has spaced parallel sidewalls that include projections that ride along the edges of the hopper.

15. The apparatus according to claim 14, wherein the sidewalls terminate in an exit which is flush with the ends of the sidewalls.

16. The apparatus according to claim 14, wherein the projections are disposed intermediate the length of the sides of the pan and define a pivot axis for the tipping of the pan as the pan is moved along the edges of the hopper.

17. The apparatus according to claim 16, wherein the projections are pins that are receivable in a series of spaced holes provided in the sides of the pan.

18. The apparatus according to claim 17, wherein the spaced parallel sidewalls of the pan terminate in an exit end and wherein the pan has a pivoted door at the exit end that opens as the pan is tipped.

19. The apparatus according to claim 18, wherein the pivoted door of the pan includes permanent magnets.

* * * * *